US007415862B2

(12) United States Patent
Futamura et al.

(10) Patent No.: US 7,415,862 B2
(45) Date of Patent: Aug. 26, 2008

(54) PRESS DEVICE

(75) Inventors: Shoji Futamura, Atsugi (JP); Keizo Ohtani, Atsugi (JP)

(73) Assignee: Hoden Semitsu Kako Kenkyusho Co., Ltd., Kanangawa (JP)

( * ) Notice: Subject to any disclaimer, the term of this patent is extended or adjusted under 35 U.S.C. 154(b) by 0 days.

(21) Appl. No.: 10/598,766

(22) PCT Filed: Aug. 26, 2005

(86) PCT No.: PCT/JP2005/015527

§ 371 (c)(1),
(2), (4) Date: Sep. 11, 2006

(87) PCT Pub. No.: WO2006/027962

PCT Pub. Date: Mar. 16, 2006

(65) Prior Publication Data

US 2007/0193331 A1 Aug. 23, 2007

(30) Foreign Application Priority Data

Sep. 9, 2004 (JP) ..... 2004-261744

(51) Int. Cl.
*B21J 9/18* (2006.01)
*B30B 1/18* (2006.01)
*B30B 15/00* (2006.01)

(52) U.S. Cl. ..... 72/454; 72/453.03; 72/453.08; 100/46; 100/231; 100/289

(58) Field of Classification Search ..... 72/454, 72/453.02, 453.03, 453.04, 453.08, 453.09, 72/17.2, 20.1, 14.8, 15.1; 100/46, 231, 267, 100/270, 271, 288, 289, 340
See application file for complete search history.

(56) References Cited

U.S. PATENT DOCUMENTS

| | | | | |
|---|---|---|---|---|
| 4,784,058 | A * | 11/1988 | Nakagawa et al. | 100/35 |
| 6,154,942 | A * | 12/2000 | Toeniskoetter | 29/243.58 |
| 6,595,122 | B1 * | 7/2003 | Mukai et al. | 100/46 |
| 2002/0170337 | A1 * | 11/2002 | Futamura et al. | 72/453.08 |
| 2003/0019267 | A1 * | 1/2003 | Futamura et al. | 72/21.3 |
| 2004/0170718 | A1 * | 9/2004 | Futamura et al. | 425/149 |

FOREIGN PATENT DOCUMENTS

| | | |
|---|---|---|
| CA | 2 495 920 | 5/2004 |
| JP | 10-277791 | 10/1998 |
| JP | 2003-230995 | 8/2003 |
| JP | 2004-141902 | 5/2004 |
| JP | 2004-358525 | 12/2004 |

* cited by examiner

*Primary Examiner*—Dmitry Suhol
(74) *Attorney, Agent, or Firm*—McGlew & Tuttle, P.C.

(57) ABSTRACT

In a press device for pressing a slider with a plurality of motors as driving sources, pressing is performed while a slider is kept horizontal even if an eccentric load is applied. In this press device, in the teaching stage, when the eccentric load is to be applied, a degree of shortage of a driving torque in each of the driving sources is determined at each timing when the eccentric load is applied so that a torque addition signal for compensating for the torque shortage is supplied to the respective corresponding driving sources corresponding to the respective timing during the actual machining

15 Claims, 10 Drawing Sheets

101
POSITION
TIME
125-i
121-i
POSITION LOOP
126-i
128-i
TORQUE
TIME
SPEED LOOP
122-i
TORQUE
129-i
127-i
DIS-TURBANCE
INERTIA MOMENT
123-i
ANGULAR SPEED
INTE-GRATION
124-i
1 SHAFT
2 SHAFT
3 SHAFT
4 SHAFT
LOAD

101
POSITION
TIME
2 SHAFT
1 SHAFT
4 SHAFT
3 SHAFT
LOAD
125-i
130-i
POSITION DEVIATION
TIME
REAL-PART
TRIAL
131-i
121-i
POSITION LOOP
POSITION DEVIATION
128-i
TORQUE
TIME
REAL-PART
SPEED LOOP
TORQUE
122-i
132-i
TRIAL
DIS-TURBANCE
127-i
129-i
123-i
INERTIA MOMENT
ANGULAR SPEED
124-i
INTE-GRATION
1 SHAFT
2 SHAFT
3 SHAFT
4 SHAFT

Prior Art

Prior Art

Prior Art

Prior Art

PRESS DEVICE

TECHNICAL FIELD

The present invention relates to a press device used in thin plate working, for example, and particularly to a press device provided with a plurality of drive shafts corresponding to a plurality of pressurizing points distributed in a slider vertically moving between a base and a support plate and a motor corresponding to each of the drive shafts as a driving source, in which the slider can be accurately driven horizontally.

BACKGROUND ART

A press device for pressing the slider by motors, which are a plurality of driving sources, is known, and the applicant filed a patent application as the Patent Document 1.

FIG. 7 shows a conventional publicly known press device. FIG. 7 is substantially the same as that disclosed in the Patent Document 1.

In FIG. 7, in a frame body 404 formed by a base 401, a support plate 402 and a plurality of guide poles 403, two sliders 405 and 406 are provided, and at the four corners of each of the sliders 405 and 406, sliding holes engaged with the guide poles 403 and through which the sliders 405 and 406 freely slide respectively in the axial direction of the guide poles 403 are provided.

On an upper face of the support plate 402, a plurality of, four in this case, for example, mounting bases 408 are provided, and a servo motor 409 for rapid traverse containing an encoder is mounted on each of the mounting bases 408.

Since the constitution and components relating to each of the servo motors 409 for rapid traverse mounted on the four mounting bases 408, which will be described below, are totally the same, only one of them will be described.

A screw shaft 410 fastened to a shaft of the servo motor 409 for rapid traverse inside the mounting base 408 is pivotally supported by the support plate 402 capable of rotation, screwed with a screw feed nut 411 fixed to the slider 406 and can penetrate the slider 405 provided further below the slider 406. Therefore, the slider 406 is raised or lowered by synchronized normal/reverse rotation of the four servo motors 409 for rapid traverse, and the slider 406 can be reciprocated by rotation control of the servo motors 409 for rapid traverse.

On the slider 406, a double-nut lock mechanism 414 for clamping, that is, fixing the screw shaft 410 onto the slider 406 is provided. When this lock mechanism 414 is operated, the screw shaft 410 is fixed (locked) onto the slider 406 and the screw shaft 410 and the slider 406 are integrated so that the screw shaft 410 and the slider 406 can not mutually move.

On an upper face of the slider 406, a plurality of, 2, 3 or 4, for example, mounting bases 415 are provided, and a servo motor 417 for pressurization containing an encoder and having a reducer 416 is mounted on each of the mounting bases 415. Since the constitution and the components of each of the servo motors 417 for pressurization mounted on the mounting base 415 are totally the same, only one of them will be described below.

A ball screw shaft 418 fastened to a shaft of the servo motor 417 for pressurization inside the mounting base 415 is screwed with a ball screw mechanism 419 with differential mechanism in which a ball and a nut member are provided inside, and pivotally supported by the slider 406 capable of rotation. The ball screw shaft 418 and the ball screw mechanism 419 with differential mechanism fixed on the upper face of the slider 405 form the structure in which the two sliders 406 and 405 are connected. That is, by rotating the plurality of servo motors 417 for pressurization provided on the mounting bases 415 in normal or reverse rotation in synchronization, the slider 405 is raised or lowered, and the slider 405 can be reciprocated by rotation control of the servo motor 417 for pressurization.

On a lower end face of the slider 405, an upper die 407 is mounted, while a lower die 420 is provided on the base 401 at a position corresponding to this upper die 407. And between the base 401 and the support plate 402, a pulse scale 421 for detecting a position of the slider 405 is mounted along each of the four guide poles 403, respectively, to detect a contact position between the upper die 407 and a work piece 422 loaded on the lower die 420 and an upper limit standby position and a lower limit lowering position of the upper die 407. Parallel control of the slider 405 or the like is performed based on the four pulse scales 421.

A control device 423 for controlling rotation of 2 to 4 servo motors 409 for rapid traverse and 2 to 4 servo motors 417 for pressurization and for controlling the lock mechanism 414 for fixing (locking) the screw shaft 410 onto the slider 406 or releasing (unlocking) the same receives various set values inputted in advance and position signals detected by the pulse scales 421 for detecting a position of the slider 405, that is, the position of the upper die 407. And the control device 423 rapidly lowers the upper die 407 through the slider 406 lowered by rotation of the screw shaft 410 by the servo motor 409 for rapid traverse and the slider 405 lowered by rotation of the servo motor 417 for pressurization, when necessary, till the time when the upper die 407 located at the upper limit standby position is brought into contact with the work piece 422 loaded on the lower die 420 or at the time immediately before the contact. After stop of the servo motor 409 for rapid traverse, the lock mechanism 414 is immediately locked and from the time when the upper die 407 is brought into contact with the work piece 422 or the time immediately before the contact to the time when the upper die 407 is lowered to a predetermined lower limit lowered position (an imaginary line position (407) of the upper die 407 in FIG. 7), the upper die 407 is lowered by the servo motor 417 for pressurization. That is, the slider 405 is decelerated as compared with the rapid lowering speed. In this case, the control device 423 brings the servo motor 417 for pressurization in the torque applied mode so that the upper die 407 presses the work piece 422 loaded on the lower die 420 so as to press the work piece 422 into a predetermined shape. After the upper die 407 reaches the lower limit lowered position, lock of the lock mechanism 414 is released (unlocked), and such control is performed that the upper die 407 is rapidly raised using both raising of the slider 405 by the servo motor 417 for pressurization and raising of the slider 406 by the servo motor 409 for rapid traverse.

After stop of the servo motor 409 for rapid traverse, the lock mechanism 414 is locked and the screw shaft 410 is fixed (locked) onto the slider 406. The lock mechanism 414 works as follows. Even if a force operates to move the slider 406 upward through the slider 405, the ball screw mechanism 419 with differential mechanism and the ball screw shaft 418 by reaction generated when the upper die 407 presses the work piece 422 loaded on the lower die 420, the rotation of the screw shaft 410 is able to be prevented by the above described integration of the screw shaft 410 and the slider 406 and then the slider 406 is not able to move upward but maintains the stop position. That is, the upper die 407 can apply a predetermined press load onto the work piece 422.

FIG. 8 shows an enlarged explanatory view of a preferred embodiment of a moving mechanism portion of the upper die with regard to a variation of an electric press machine corresponding to FIG. 7, and the same components as those in FIG. 7 are given the same reference numerals. Also, FIG. 8 is substantially the same as that disclosed in the Patent Document 1.

In FIG. 8, inside the frame body 404 formed by the base, not shown, the support plate 402 and the plurality of guide poles 403, a slider 460 is provided, and at four corners of the slider 460, sliding holes engaged with the guide poles 403 and through which the sliders 460 freely slide in the axial direction of the guide poles 403 are provided, respectively.

On the upper face of the support plate 402, a plurality of, two or four, for example, mounting bases 461 are provided, and the servo motor 409 for rapid traverse containing an encoder is mounted on each of the mounting bases 461 through the reducer 416 (the reducer 416 may be omitted).

Since the constitution and components relating to each of the servo motors 409 for rapid traverse mounted on the plurality of mounting bases 461, which will be described below, are totally the same, only one of them will be described.

An output shaft 462 of the servo motor 409 for rapid traverse penetrating the mounting base 461 mounted on an upper face of the support plate 402 is connected to the tip end of a ball screw shaft 463 through a coupling 464. At a hole 465 provided on the support plate 402, a bearing 467 fitted in the ball screw shaft 463 through a bearing holder 466 is mounted, and the ball screw shaft 463 driven by the servo motor 409 for rapid traverse is mounted onto the support plate 402 capable of rotation.

On the support plate 402, a lock mechanism 468 is provided. This lock mechanism 468 is comprised by a gear 439 fixed to the ball screw shaft 463 and a solenoid 440 having a gear piece 441 meshed with the gear 439. When this lock mechanism 468 is operated, the gear piece 441 is meshed with a tooth of the gear 439, the ball screw shaft 463 is fixed to the support plate 402, and the ball screw shaft 463 is integrated with the support plate 402 so that the ball screw shaft 463 can not be rotated any more.

On an upper face of the slider 460, a support body 470 with a hollow 469 inside is fastened. At the hollow 469 of this support body 470, a hole 473 at the center capable of free rotation of the ball screw shaft 463 together with a hole (not shown) provided at the slider 460, a worm wheel 476 supported by an upper and a lower bearings 474 and 475 for thrust load and rotatably supported around the ball screw shaft 463 as a center shaft, and a servo motor 478 for pressurization containing an encoder to which a worm 477 meshed with the worm wheel 476 is fixed are provided. At an upper portion of the worm wheel 476, a ball screw mechanism 479 provided with a ball and a nut member inside to screw with the ball screw shaft 463 is fixed capable of rotation in the form projecting to a ceiling portion of the support body 470.

When the servo motor 478 for pressurization is stopped, mesh between the worm 477 fixed to the output shaft of the servo motor 478 for pressurization and the worm wheel 476 makes the ball screw mechanism 479 fixed at the upper portion of the worm wheel 476 to be integrated with the slider 460. Then, the ball screw shaft 463 is driven by normal rotation/reverse rotation of the servo motor 409 for rapid traverse, the slider 460 is raised or lowered through a connecting mechanism (third connecting mechanism) 471 constituted by the ball screw mechanism 479 screwed with the ball screw shaft 463, the worm wheel 476, the two bearings 474 and 475, the support body 470 or the like, and the slider 460 can be reciprocated by rotation control of the servo motor 409 for rapid traverse.

Also, when the servo motor 478 for pressurization is rotated in the normal/reverse direction in the state where the lock mechanism 468 is operated and the ball screw shaft 463 and the support plate 402 are integrated, a rotation portion constituted by the worm wheel 476 and the ball screw mechanism 479 is rotated through the ball screw shaft 463 in the stationary state, and the slider 460 is raised or lowered. That is, the slider 460 can be reciprocated by rotation control of the servo motor 478 for pressurization.

After the servo motor 409 for rapid traverse is stopped, the lock mechanism 468 is locked and the ball screw shaft 463 is fixed to the support plate 402. This reason is as follows. That is, an unwanted action operates so as to move the slider 460 upward and then to rotate the ball screw shaft 463 by reaction generated when the upper die 407 presses the work piece 422 loaded on the lower die 420. In this invention, even if the unwanted action to move the slider 460 upward tries to rotate the ball screw shaft 463, the ball screw shaft 463 and the support plate 402 are integrated as above, then the ball screw shaft 463 is prevented from being rotated. Thus, the upper die 407 can apply a predetermined press load onto the work piece 422.

Though not shown, the upper die 407 (See FIG. 7) is mounted on a lower end face of the slider 460, and a lower die 420 (See FIG. 7) is provided on the base 401 (See FIG. 7) at a position corresponding to the upper die 407. And between the base 401 and the support plate 402, the pulse scale 421 for detecting a position of the slider 460 is provided along each of the four guide poles 403 to detect a position of contact between the upper die 407 and the work piece 422 (See FIG. 7) loaded the lower die 420 as well as an upper limit standby position and a lower limit lowered position of the upper die 407.

A control device 480 for controlling rotation of each of the servo motors 409 for rapid traverse and the servo motors 478 for pressurization and the lock mechanism 468 for fixing (locking) the ball screw shaft 463 onto the support 402 or releasing (unlocking) the same receives various set values inputted in advance and position signals detected by the pulse scales 421 for detecting a position of the slider 460, that is, the position of the upper die 407. And the control device 480 rapidly lowers the upper die 407 through the rotation of the ball screw shaft 463 by the servo motor 409 for rapid traverse and the rotation of the rotation portion of the connecting mechanism 471 by the servo motor 478 for pressurization, when necessary, till the time immediately before the upper die 407 located at the upper limit standby position is brought into contact with the work piece 422 loaded on the lower die 420. After stop of the servo motor 409 for rapid traverse, the lock mechanism 468 is immediately locked so that the support plate 402 and the ball screw shaft 463 are fixed, and from the time the upper die 407 is brought into contact with the work piece 422 or the time immediately before the contact till the upper die 407 is lowered to a predetermined lower limit lowered position (the imaginary line position (407) of the upper die 407 in FIG. 7), the upper die 407 is lowered through the slider 460 by rotation of the rotation portion of the connecting mechanism 471 under fixation between the support plate 402 and the ball screw shaft 463 at a speed slower than the above rapid lowering speed. In this case, the control device 480 brings the servo motor 478 for pressurization in the torque applied mode under the fixation between the support plate 402 and the ball screw shaft 463 so that the upper die 407 presses the work piece 422 loaded on the lower die 420 so as to press the work piece 422 into a predetermined shape. After the upper die 407 reaches the lower limit lowered position, lock of the lock mechanism 468 is released, and such control is performed that the upper die 407 is rapidly raised to the original upper limit standby position through the slider 460 using both the servo motor 409 for rapid traverse and the servo motor 478 for pressurization under release of fixation between the support plate 402 and the ball screw shaft 463.

The internal structure of the nut member of the ball screw shaft 479 is, as shown in FIG. 8, a ball arranged in a ball groove of the ball shaft screw 463 is circulated from a lower ball groove to an upper ball groove by rotation of the ball screw shaft 463 and the ball screw mechanism 479, and by this circulation of the ball, locally concentrated abrasion of the ball can be avoided.

Also, since ball-bearing position adjusting means 481 is provided between the slider 460 and a base disk 482, a differential member 453 is moved in the right and left directions in the drawing by rotating a screw portion 457. Therefore, a nut member of the ball screw mechanism 479 is moved through the base disk 482 on which the support body 470 is mounted for an extremely short distance in the perpendicular direction. By this, the ball groove in the nut member of the ball screw mechanism 479 changes its position in contact with the ball arranged in the ball groove in the ball screw shaft 463 at loading of the press working, that is, the position of the ball groove in contact with the ball in the nut member of the ball screw mechanism 479 is changed at loading of the press working, and durability of the nut member of the ball screw mechanism 479 is ensured as compared with the constitution that the ball is brought into contact with the same position every time.

In the press device as shown in FIGS. 7 and 8, the control device 423 (or 480) performs driving control for the servo motor 409 for rapid traverse and the servo motor 417 (or 478) for pressurization in press working.

FIG. 9 shows a block diagram for driving control for the servo motor for rapid traverse and the servo motor for pressurization. It is to be noted that FIG. 9 shows a block diagram of only one pair of the servo motor for rapid traverse and the servo motor for pressurization, but it may be considered that the similar control is performed for each of plural pairs.

Reference numeral 101 in FIG. 9 is a time/position pattern generation portion for generating information specifying the position that the slider should take according to time when the press working progresses (corresponding to individual time). And reference numerals 111 and 121 show servo modules for position loop, respectively, while reference numerals 112 and 122 for servo modules for speed loop, respectively.

Moreover, reference numeral 113 is an inertia moment response portion corresponding to the servo motor for rapid traverse for outputting an angular speed of the servo motor for rapid traverse. Reference numeral 123 is an inertia moment response portion corresponding to the servo motor for pressurization. Furthermore, reference numerals 114 and 124 are integration response portions corresponding to integration of an inputted angular speed, and in an example shown in FIG. 7 or 8, it may be considered as an output from the pulse scales 421 representing an actual position of the slider. Also, reference numerals 115, 116, 117, 125, 126 and 127 denote adders, respectively.

According to the time when press working progresses (corresponding to individual time), a signal of position that the slider should take is generated by an NC device, not shown, for example. That is, it is supplied to the servo modules 111 and 121 for position loop. In the adders 115 and 125, a deviation between the position signal which should be taken and an actual position signal of the slider is acquired, and the deviation is inputted into the servo modules 111 and 121 for position loop. The servo modules 111 and 121 for position loop issue velocity signals corresponding to the servo motor for rapid traverse and the servo motor for pressurization, respectively.

The adders 116 and 126 acquire deviation between the respective velocity signals and actual angular speed signal of the servo motor for rapid traverse and the servo motor for pressurization, which are supplied to the servo modules 112 and 122 for speed loop, respectively. And they become signals dealing with disturbance generated in some cases at the adders 117 and 127 and drive the servo motor for rapid traverse and the servo motor for pressurization.

In the case shown in FIG. 9, so-called feedback control is performed that the deviation between the signal position which should be taken by the slider and the actual signal position of the slider is acquired particularly at the adders 115 and 125. Though not shown, if plural pairs of motors for vertically moving the slider exist as shown in FIG. 7 or 8, control according to the block diagram corresponding to one pair of motors as shown in FIG. 9 is performed to each of the plural pairs. And such control is performed that the slider is correctly and horizontally (without being tilted) lowered during press working by the plural pairs of motors.

Patent Document 1: Unexamined Japanese Patent Application (Kokai) No. 2004-358525

DISCLOSURE OF THE INVENTION

Problem to be Solved by the Invention

In the conventional press working device as described above, each of the plural pairs of motors is controlled based on the feedback control in the constitution shown in FIG. 9 and each of the motor pairs is driven so that the slider at the respective pressurizing points should be kept at a position which should be taken.

FIG. 10 shows a block diagram when four pairs of motors in total exist. In FIG. 10, only the block diagram corresponding to the servo motor for pressurization shown in FIG. 9 is taken up and depicted that the four pairs of servo motors for pressurization exist as the motor for #1 shaft, that for #2 shaft, that for #3 shaft and that for #4 shaft.

Reference numerals shown in FIG. 10 correspond to those in FIG. 9, in which reference numeral 102 denotes a position correction signal output portion, and reference numeral 103 denotes an adder.

Action of each of constitutional units, 121-*i*, 123-*i*, 123-*i* and 124-*i* shown in FIG. 10 is the same as the description made in relation with FIG. 9, but in FIG. 10, the position correction signal output portion 102 is provided.

The position correction signal output portion 102 receives ticking actual position signals of the slider at pressurizing points corresponding to each of the four pairs of the servo motors for pressurization and, generates a position correction signal capable of correction of a delay of the shaft from the other shafts (the shaft with least delay, for example) corresponding to the shaft of each of the four pairs and adds it to the adder 103-*i*.

With regard to the position correction signal corresponding to each shaft, a position correction signal to be applied to each shaft each time is determined after several teaching processing stages to prepare for a real-part working.

FIG. 11 is a diagram for explaining a state where horizontalness of the slider is collapsed by an eccentric load. FIG. 11A shows a state where a load is generated by an eccentric load corresponding to four shafts, while FIG. 11B shows a state where the #1 shaft and the #4 shaft are delayed from the #2 shaft and the #3 shaft in that case.

FIG. 11 shows a situation that a delay of about 0.08 mm is generated for the #1 shaft and the #4 shaft with respect to the #2 shaft ad the #3 shaft in a position command of 432.6 mm, for example, under a situation that the four shafts are delayed by 0.89 mm all together till the point of a position command of 435.2 mm as shown in FIG. 11B, in case that an eccentric load is rapidly generated at a position of a load point (cross mark) shown in FIG. 11A and then the eccentric load disappears thereafter or the eccentric load is not changed thereafter. This situation means that the delay is generated at the #1 shaft and the #4 shaft with larger load bearing. It is to be noted that in FIG. 11B, actual measurement was made at the cross mark points and they are connected by a line, and it is possible that a dotted line representing the delay of the #1 shaft and the #4 shaft is actually vibrated as shown by a dashed line.

The position correction signal output portion 102 shown in FIG. 10 has a role to supply a correction signal to each shaft so that a delay as shown in FIG. 11 (delay in response to each shaft) is corrected. And as mentioned above, it prepares for the real-part working.

However, even if the real-part working was prepared for by preparing the position correction signal output portion 102 as shown in FIG. 10, it was found out that there was a problem as described below.

That is, when a working speed of the press working is made large, the position correction signal output portion 102 receives an actual position signal from the #1 shaft or the #4 shaft and outputs the correction signal. Thus, it was found out that it is not possible to perform press working while correctly holding the slider horizontally due to the delay in response in the feedback control.

The present invention was made in view of the above problem and additional driving to increase a torque for each time stage or press position stage is conducted for a required shaft in response to an eccentric load so that the slider can be lowered under the correct horizontal state.

Means for Solving the Problem

In order to achieve the object, a press device according to the present invention comprises a base;

a support plate supported in parallel with the base through a plurality of guide poles installed upright on the base;

a slider capable of sliding on the guide poles and capable of vertical movement between the base and the support plate;

a plurality of drive shafts engaged with a plurality of pressurizing points distributed on the slider for pressing the slider;

a plurality of motors for driving each of the drive shafts respectively;

control means for driving control of each of the motors independently among the plurality of motors; and displacement measuring means for measuring position displacement of the slider with respect to the base, wherein, in teaching processing performed in advance and/or simulation, data of torque against time or press position are extracted at each time stage or each press position stage during working, said data being able to correct inclination of the slider during working at each time stage or each press position stage based on rotation of the drive shaft by each of the motors and having to be supplied to each of the motors, and in press working, the control means performs additional driving based on the said data of torque against time or press position for each of the motors at each of the time stage or press position stage where each of the motors is independently driven and controlled.

Effect of the Invention

In the present invention, a torque can be increased for each required shaft at an appropriate time or an appropriate press position in response to an eccentric load, and undesired inclination of a slider caused by a delay in response to feedback control which has been generated in a conventional case can be eliminated.

DESCRIPTION OF SYMBOLS

Figure 1A:
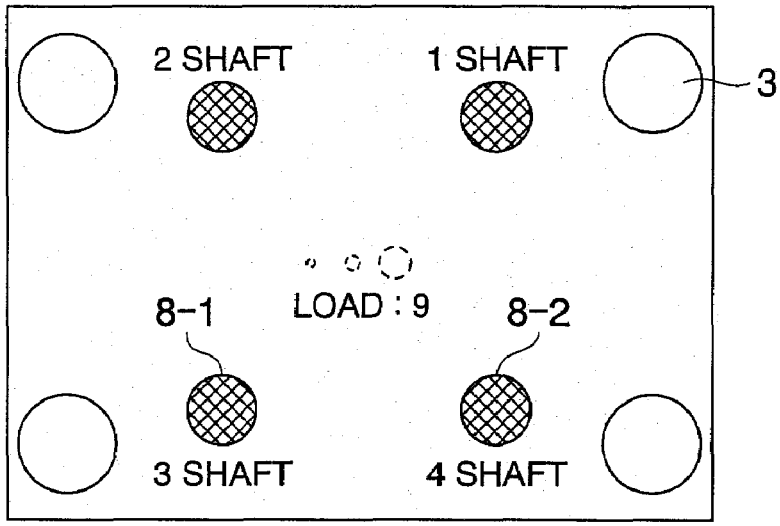
FIG. 1 shows a situation when a position on which an eccentric load is applied in response to driving of four shafts is sequentially changed.

1: Base
2: Support plate
3: Guide pole
4: Frame body
5: Slider
6: Servo motor
7: Screw shaft
8: Nut portion
9: Load

BEST MODE FOR CARRYING OUT THE INVENTION

With regard to a press device in which four pairs, for example, of motors are independently driven and cooperatively drives a slider, it is so constituted that, even if an eccentric load is generated, a torque capable of handling the eccentric load is applied to each of the motor pairs so that the slider can be kept correctly in the horizontal state even during the press working.

EXAMPLE 1

FIG. 1 shows a situation when a position on which an eccentric load is applied in response to driving of four shafts is sequentially changed.

Figure 1B:
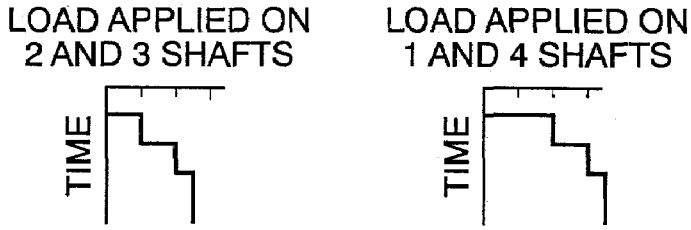
Figure 1C:
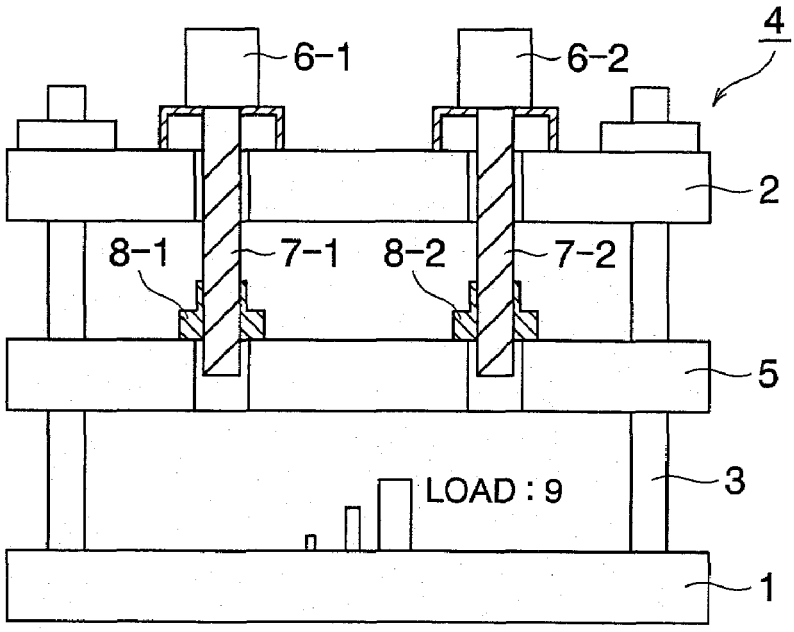

FIG. 1A shows a situation that a load is applied to the four shafts, FIG. 1B shows time change of the load applied to a #2 shaft and a #3 shaft and the time change of the load applied to a #1 shaft and a #4 shaft, and FIG. 1C shows a situation that the slider is lowered with respect to the load.

In Figures, reference numeral 1 denotes a base, 2 for a support plate, 3 for a guide pole, 4 for a frame body, 5 for a slider, 6 for a servo motor, 7 for a screw shaft, 8 for a nut portion and 9 for a load.

Figure 7:
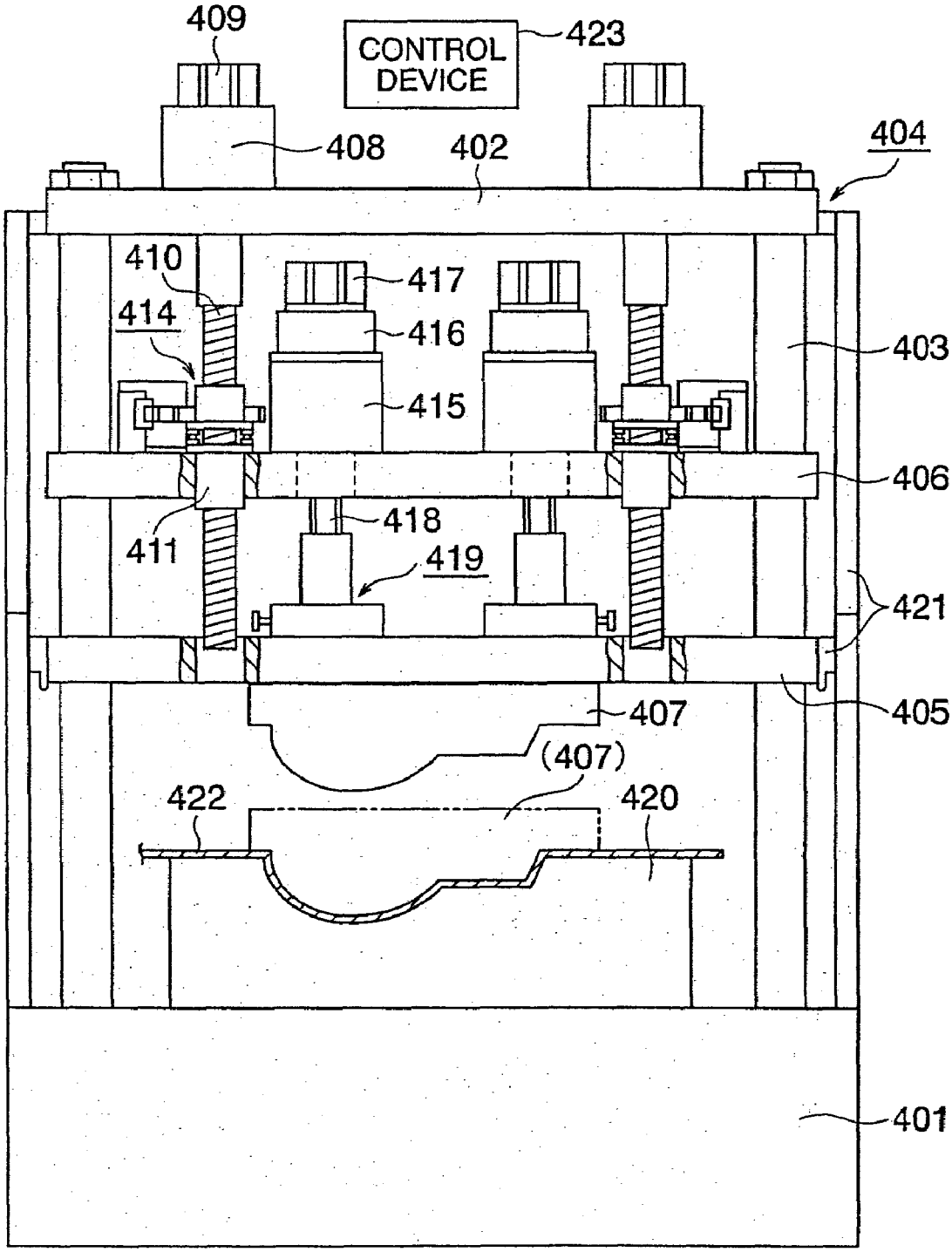
FIG. 7 shows a publicly known conventional press device.
Figure 8:
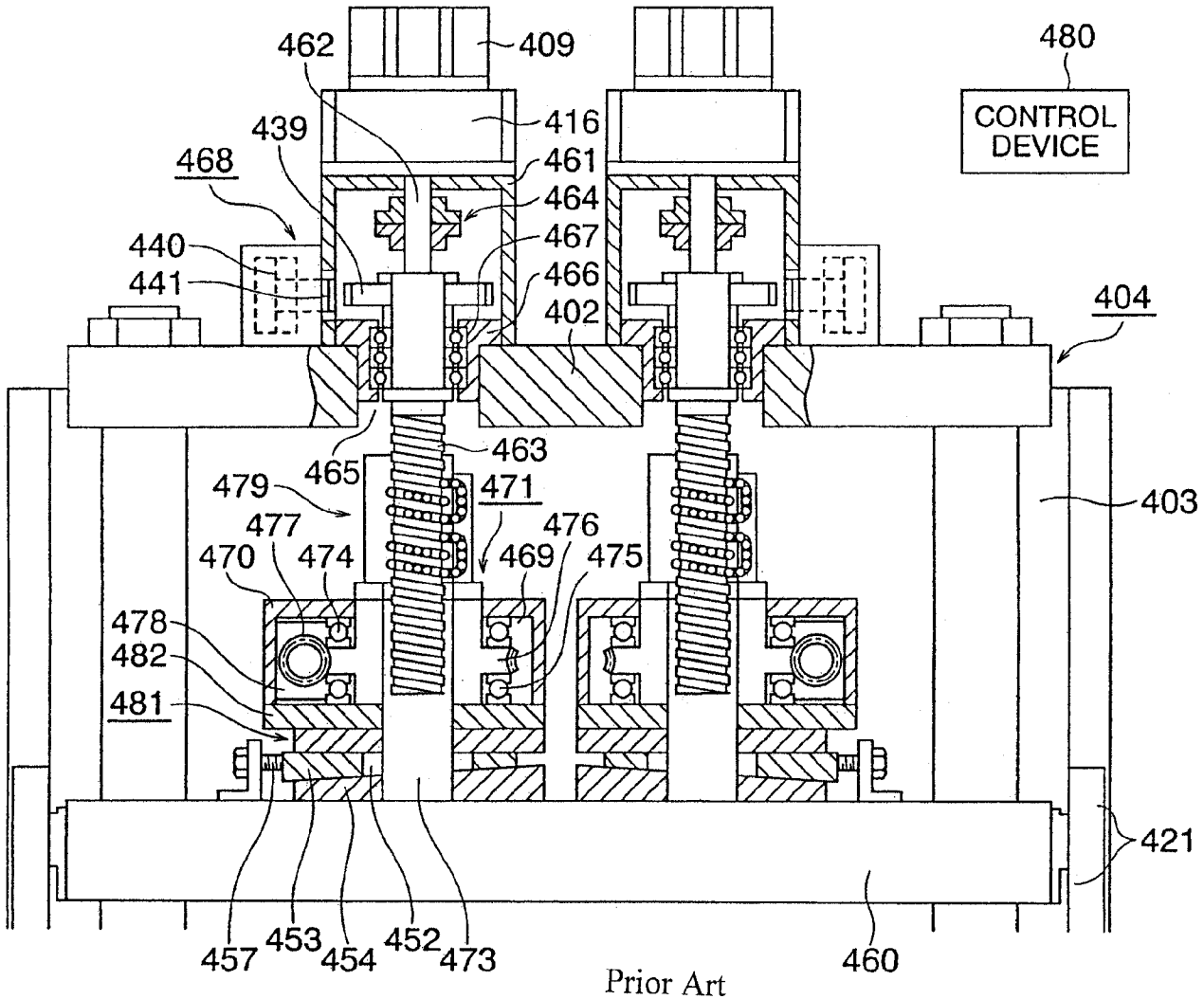
FIG. 8 shows an enlarged explanatory view of a preferred embodiment of a moving mechanism portion of an upper die for the variation of the electric press machine corresponding to FIG. 7.
Figure 9:
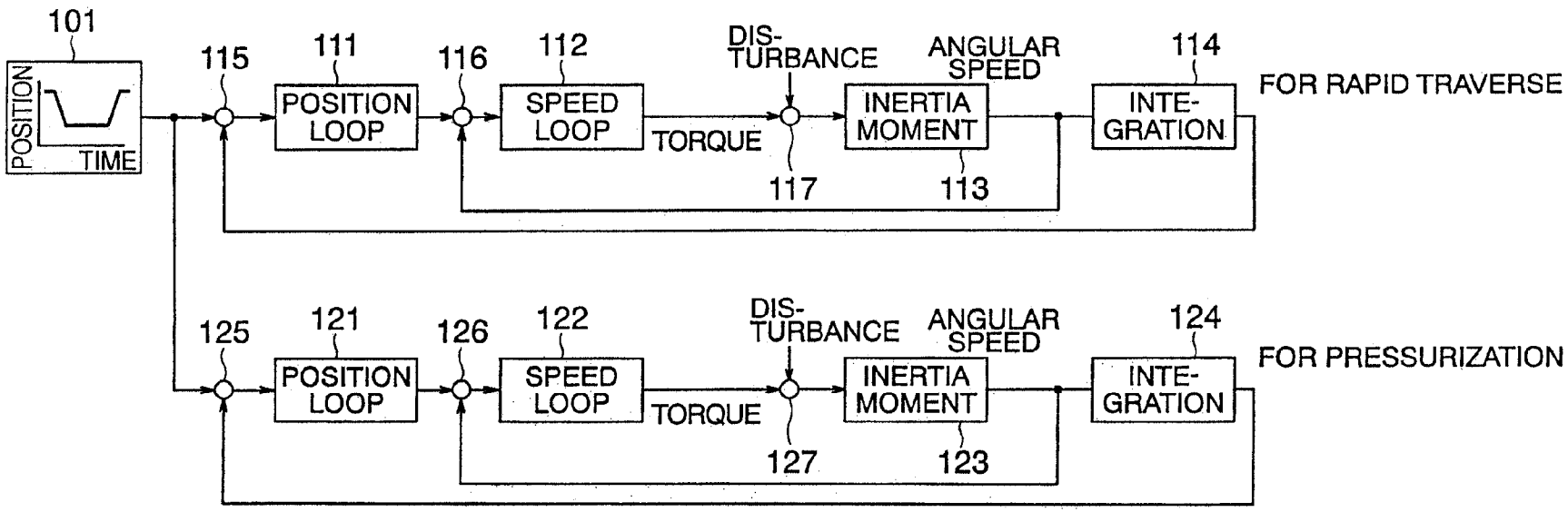
FIG. 9 shows a block diagram for driving control for a servo motor for rapid traverse and a servo motor for pressurization.

The press device used in the present invention is provided with, as shown in the above FIGS. 7 and 8, a servo motor for rapid traverse and a servo motor for pressurization, but in FIG. 1C, the constitution as shown in FIGS. 7 and 8 is simplified and shows one servo motor 6-*i* existing corresponding to each of the #1 shaft to #4 shaft.

As shown in FIG. 1C, supposing that loads with different heights exist, when the slider 5 is lowered, a load point based on the load 9 is sequentially generated at positions shown by circles of a dotted line. At this time, loads with the size as shown on the left of FIG. 1B is generated in the #2 shaft and the #3 shaft in the stepped state, while the load with the size as shown on the right of FIG. 1B is generated in the #1 shaft and the #4 shaft in the stepped state.

Figure 10:
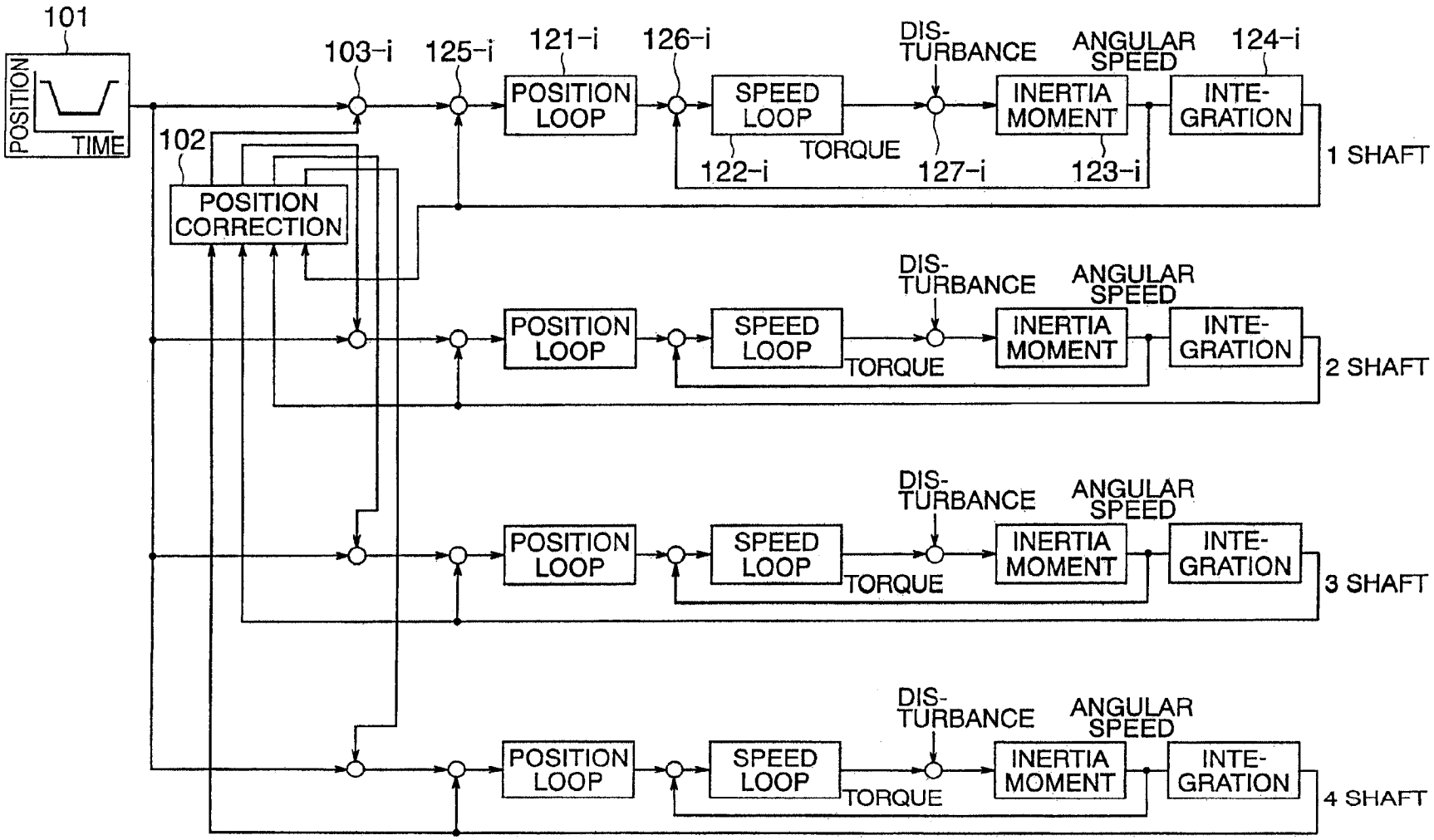
FIG. 10 shows a block diagram when a plurality of motor pairs totaling in four exist.
Figure 11A:
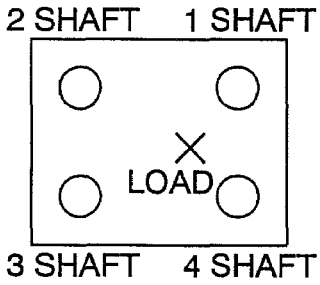
FIG. 11 is a diagram for explaining the state where horizontalness of the slider is collapsed by the eccentric load.

When such an eccentric load is applied to the slider 5, in the conventional case, a delay is generated with respect to a position command in response to each of the shafts as described in relation with FIGS. 10 and 11, and the delay can not be solved as mentioned above even if a position correction signal has been determined in the teaching stage to prepare for real-part press working.

Figure 2:
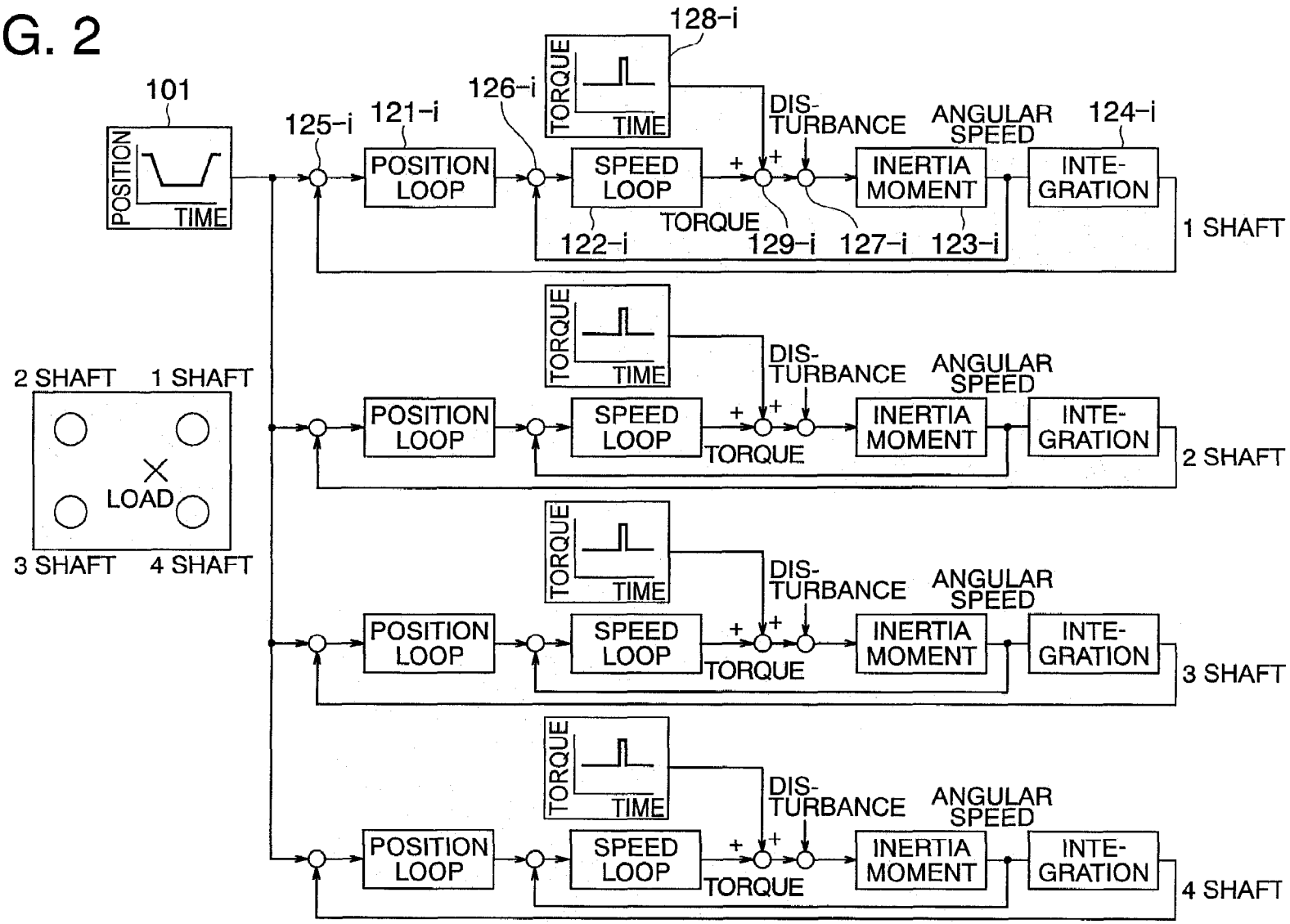
FIG. 2 is a block diagram of a preferred embodiment showing control in the present invention.

FIG. 2 shows a block diagram of a preferred embodiment showing control in the present invention. It is to be noted that FIG. 2 is a diagram corresponding to the above-mentioned FIG. 10.

In Figure, reference numeral 101 is a time/position pattern generation portion that the slider should take in press working, and information specifying a position that the slider should be located is generated according to time when the press working progresses (corresponding to individual time). And reference symbol 121-*i* denotes a servo module for position loop and reference symbol 122-*i* for a servo module for speed loop.

Moreover, reference symbol 123-*i* denotes an inertia moment response portion corresponding to the servo motor for pressurization for outputting an angular speed of the servomotor for pressurization. Furthermore, reference symbol 124-*i* denotes an integration response portion and responds to integration of the inputted angular speed. That may be considered as an output from the pulse scale 421 representing an actual position of the slider in the example in FIGS. 7 and 8. Reference symbols 125-*i*, 126-*i* and 127-*i* denote adders, respectively. It is to be noted that reference symbol 128-*i* is a torque against time data holding portion per time stage during working, and reference symbol 129-*i* denotes an adder. Reference symbol 128-*i* is constituted as a torque against time data holding portion per time stage during working but it may be a torque against press position data holding portion of each press position stage during working (hereinafter both will be described as "torque against time data" or "data of torque against time " of "each time stage" to avoid repetition).

As shown on the left in FIG. 2, suppose that an eccentric load is applied to the four shafts at a position shown by the cross mark. In this case, even if response is considered in a possible range in the teaching stage, as described referring to FIG. 1, a delay in driving is generated in the #1 shaft and the #4 shaft when compared with the #2 shaft and the #3 shaft due to a delay in response of the control system. The above-mentioned FIG. 11B shows such a case.

In order to solve this point, in the preferred embodiment shown in FIG. 2, an additional driving signal (torque addition signal) outputted from the torque against time data holding portion 128-*i* is applied to a torque signal from the servo module 122-*i* for speed loop when driving each of the shafts.

Figure 11B:
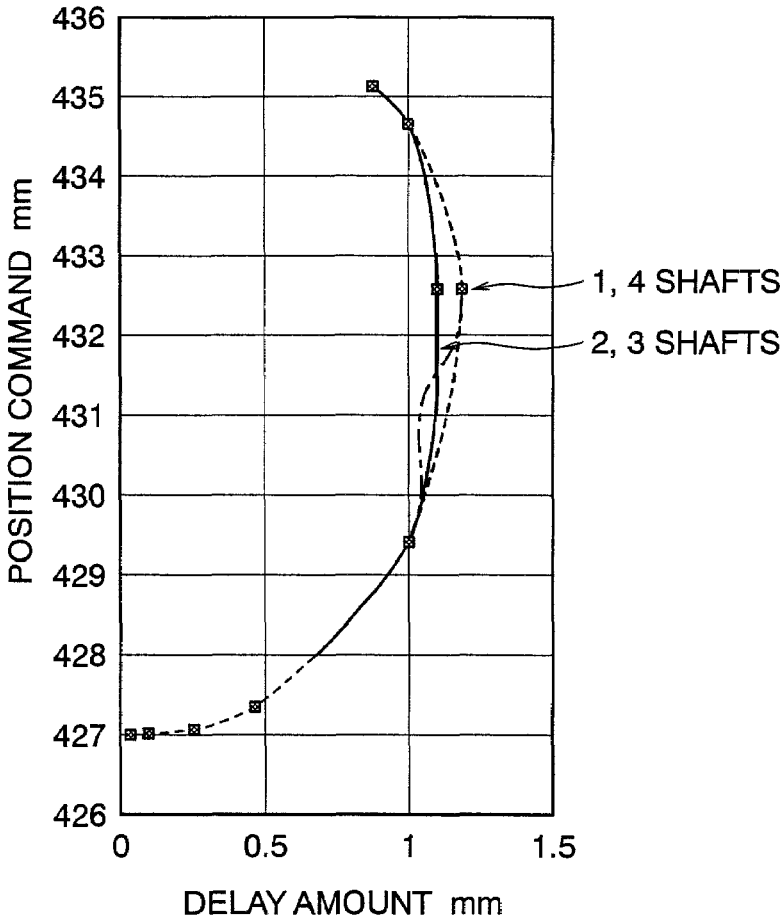

That is, when it is found out in the teaching stage that a delay as described referring to FIG. 11B is generated based on an eccentric load at a certain time, in the case of the example shown in FIG. 11B, such a value that a delay of about 0.08 mm is not made to generate in a position command of 432.6 mm is set as a torque addition signal for the torque against time data holding portion (128-1 and 128-4) corresponding to the #1 shaft and the #4 shaft at a predetermined time (a time or a press position to be 435.2 mm in the position command or a time or a press position immediately before that). It is needless to say that in this example, the torque addition signal under this timing is set to zero for the torque against time data holding portion (128-2 and 128-3) corresponding to the #2 shaft and the #3 shaft.

By setting the above torque addition signal, the above torque addition signal is applied to the #1 shaft and the #4 shaft at a predetermined timing during the real-part working through the adder 129-*i*. That is, in the servo motor for pressurization for driving the #1 shaft and the #4 shaft (in the example shown in FIG. 1, the motor 6-1 and the motor 6-4 (the motor 6-4 is not shown, though)), a torque is increased at the predetermined timing, and a delay as shown in FIG. 11B is not generated any more. Since the additional torque is forcibly applied at a scheduled timing, there is no delay generated in the control system but the press working can be performed while holding the slider horizontally.

Figure 3B:
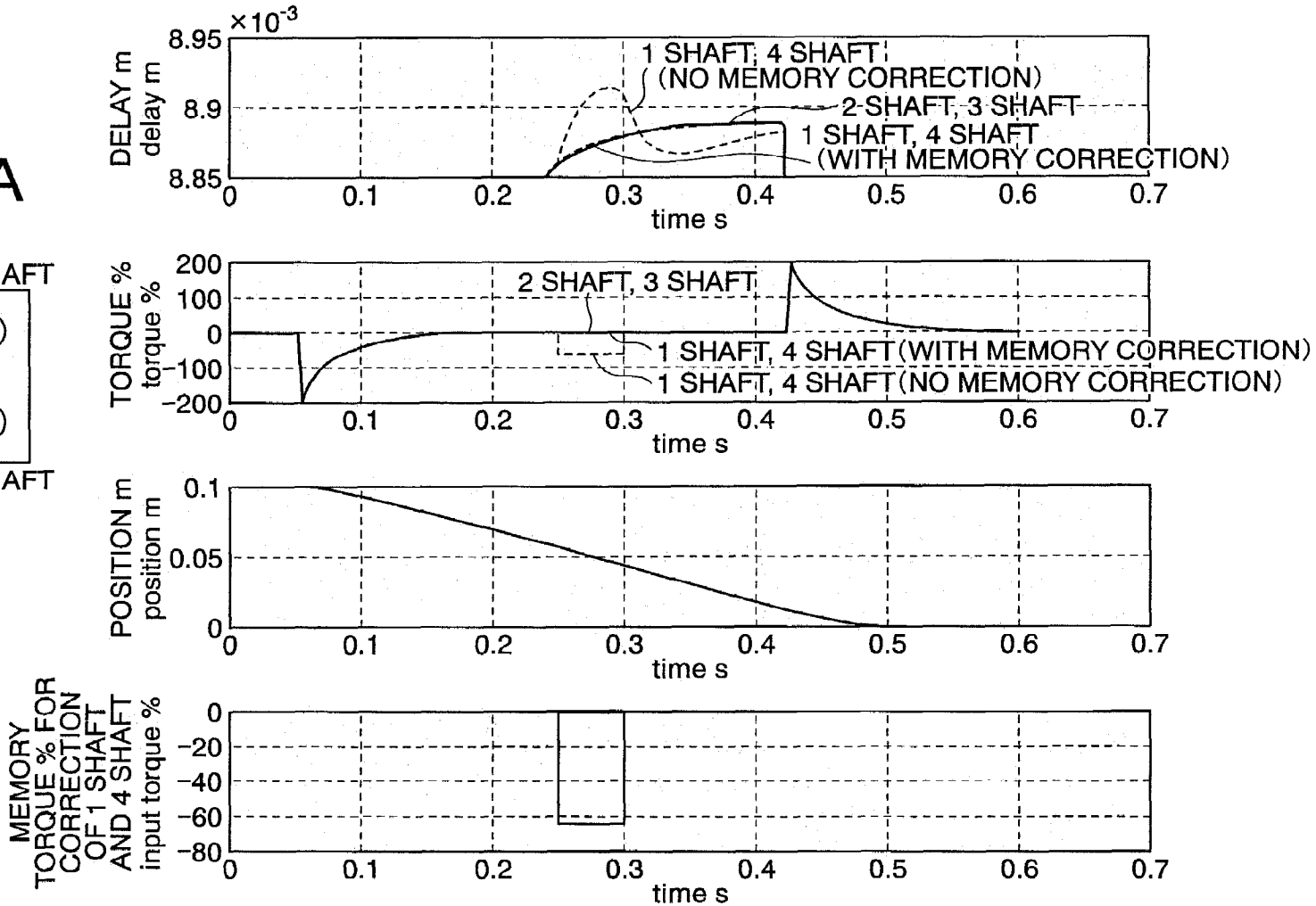
FIG. 3 shows a case where the above-mentioned torque addition signal is not supplied and a case where the signal is supplied corresponding to the #1 shaft and the #4 shaft when an eccentric load is generated.
Figure 3A:
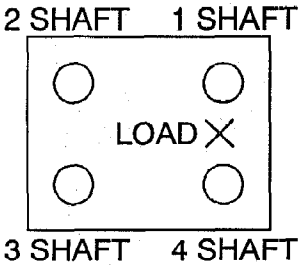

FIG. 3 shows a case where the above torque addition signal is not supplied and a case where the signal is supplied corresponding to the #1 shaft and the #4 shaft when an eccentric load is generated under the positional relation as shown in FIG. 3A.

In an experiment from which FIG. 3 was obtained, a stroke in press working is 0.1 m, the press working with the stroke of 0.1 m is repeated 40 times per minute (40 strokes/minute), and the #1 shaft and the #4 shaft receive a load of 3 ton between 0.25 sec. and 0.3 sec.

A graph of delay against time in FIG. 3B shows how the delay is generated at what time in each of the shafts corresponding to a command value supplied all together to the #1 shaft to the #4 shaft. It is to be noted that only delays within a range of $8.85\times10^{-3}$ m to $8.95\times10^{-3}$ m are shown in this graph.

In this graph, a delay from the #2 shaft and the #3 shaft is shown by a solid line and when the torque addition signal shown in FIG. 2 does not exist (no memory correction in Figure), a delay is generated at 0.25 sec. in the #1 shaft and the #4 shaft in the vibrated manner, but by supplying the torque addition signal, the delay in the vibrated manner in the #1 shaft and the #4 shaft is solved. That is, the curve becomes the same as the delay from the #2 shaft and the #3 shaft. In this graph, it is shown that the delay is lowered below $8.85\times10^{-3}$ m in the vicinity of 0.426. This shows that a load for press working including a load with the eccentric load was drastically lowered.

In the case of this experiment, the torque addition information of about 60.4% is applied to the #1 shaft and the #4 shaft for the period from 0.25 sec. to 0.3 sec. as shown in the lowermost drawing in FIG. 3B.

In this result, as shown in the torque against time graph in FIG. 3B, the torque shortage generated during the period from 0.25 sec. to 0.3 sec. in the #1 shaft and the #4 shaft is solved, and as described in relation with the delay against time graph in FIG. 3B, the delay has been solved. And in the graph of position against time representing a stroke of the press working, it is known that the press working progresses with the four shafts behaving totally the same.

EXAMPLE 2

Figure 4:
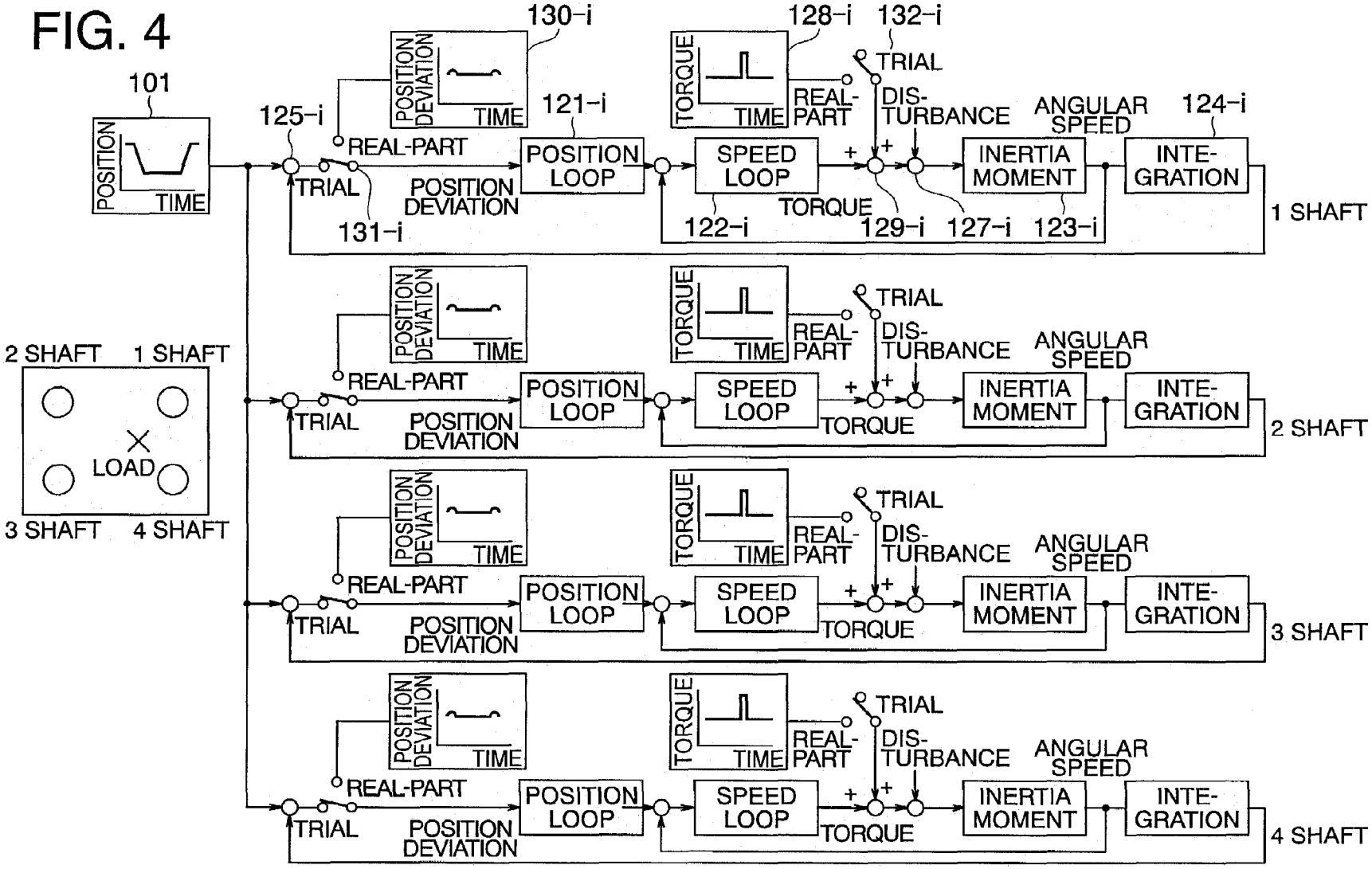
FIG. 4 shows a variation of a feedback format shown in FIG. 2.

FIG. 4 shows a variation of the feedback format shown in FIG. 2. Reference numerals in Figure correspond to those in FIG. 2. And reference symbol 130-*i* denotes a position deviation against time memory held by taking in a deviation (delay) from a command value corresponding to each of the shafts obtained during teaching, and this deviation signal is directly supplied to the servo module 121-*i* for position loop at each time during the real-part working. Reference symbols 131-*i* and 132-*i* denote switches between the teaching stage and the real-part stage.

In FIG. 4, there is not a feedback loop through the adder 125-*i* any more during the real-part working. That is, in the real-part press working, it becomes so-called feed-forward control system. In other words, the feed-forward control system is in the form that "disturbance compensating for torque shortage" is supplied to the adder 129-*i*.

EXAMPLE 3

Figure 5:
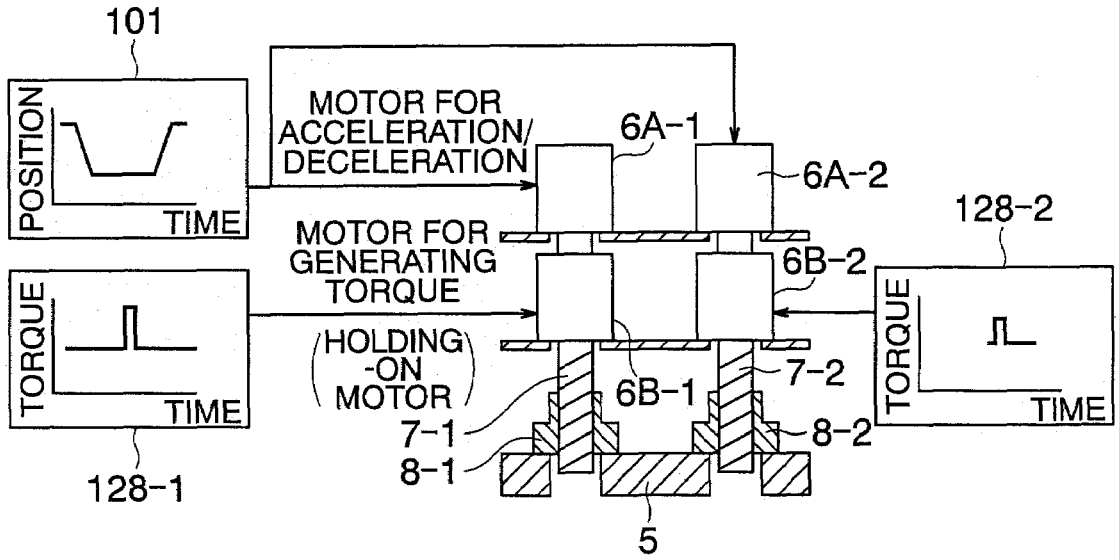
FIG. 5 shows a preferred embodiment in which another motor for applying a torque for supplying torque application information to a servo motor for pressurization is provided.

FIG. 5 shows a preferred embodiment in which a motor for applying a torque for supplying torque addition information to the servo motor for pressurization is separately provided. Reference numerals in Figure correspond to those in FIGS. 1 and 2.

In FIG. 5, separately from a motor 6A-i (motor for acceleration/deceleration in Figure) following a signal from the time/position pattern generation portion 101 in FIG. 2, a motor 6B-i (motor for generating a torque in Figure, that is Holding-on motor) following a signal from a torque against time data holding portion 128-*i* shown in FIG. 2 is provided. It is needless to say that the motor 6B-i is rotated and driven only in a time zone for supplying the additional torque.

EXAMPLE 4

Figure 6:
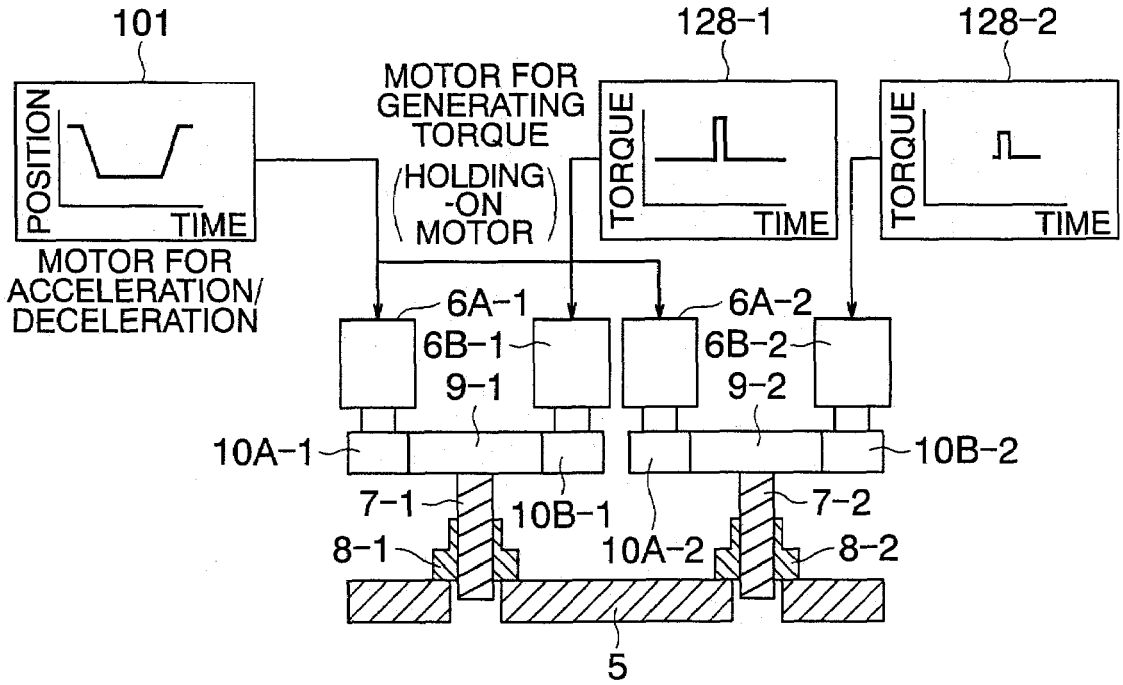
FIG. 6 shows another variation of the preferred embodiment shown in FIG. 5.

FIG. 6 shows another variation of the preferred embodiment shown in FIG. 5. Reference numerals in Figure correspond to those in FIG. 5. Reference symbols 9-*i*, 10A-i and 10B-i denote gears, respectively.

The preferred embodiment shown in FIG. 5 is constituted such that one screw shaft 7-*i* is directly driven by the motor 6A-i and the motor 6B-i together, but in the preferred embodiment shown in FIG. 6, one screw shaft 7-*i* is driven through the gears 10A-i , 10B-i and 9-*i*. And as in the case in FIG. 5, the motor 6B-i is rotated and driven only in a time zone for supplying the additional torque.

The one motor 6A-i shown in FIGS. 5 and 6 may use a pulse motor following a command value, while the other motor 6B-i may use an AC servo motor, for example, for compensating for torque shortage in the pulse motor 6A-i.

FIGS. 2, 4, 5 and 6 show as if the torque against time data holding portion 128-*i* prepares a torque addition signal only at a single predetermined time, but in general, torque addition signals required for respective plural times are issued. Moreover, a delay of a shaft with the least delay with respect to the command value is made as a reference and a torque addition signal is prepared for the other shafts so as to align with the delay in the reference shaft corresponding to the respective predetermined time. It is needless to say that consideration may be given so that a torque for the shaft with the least delay is reduced at a predetermined time. It is also needless to say that the torque addition signal has a value so as to compensate for the delay with respect to the command value for all the shafts.

INDUSTRIAL APPLICABILITY

According to the present invention, in a press device for press working with a plurality of motors as driving sources, even if an eccentric load is generated at each stage of pressing a work piece, a slider can be kept horizontally with a high accuracy. That is, there is not such an event that the slider is undesirably inclined during lowering and blocks its sliding operation on a support pole, for example. By this, it is made possible to press the work piece in a complicated shape with a high accuracy.

The invention claimed is:

1. A press device comprising:

a base;

a support plate supported in parallel with the base through a plurality of guide poles installed upright on the base;

a slider capable of sliding on said guide poles and capable of vertical movement between said base and said support plate;

a plurality of drive shafts engaged with a plurality of pressurizing points distributed on the slider for pressing the slider;

a plurality of motors for driving each of the drive shafts respectively;

a control means for driving control of each of the motors independently among the plurality of motors; and a plurality of displacement measuring means for measuring position displacement of said slider with respect to said base, said control means having an extraction data means for extracting displacement data corresponding to inclination of said slider during actuation of slider at a plurality of time periods based on rotation of each drive shaft by each of said motors and for extracting data of torque supplied to each said motor as a function of time at each said time period during actuation of said slider; and a driving and controlling means for performing additional torque strengthening driving such that additional torque is applied to each of said motors based on said data of torque as a function of time for each of said motors at each of said time periods, each of said motors being independently driven and controlled to correct said inclination of said slider based on said data of torque as a function of time.

2. The press device according to claim 1, wherein the data of torque as a function of time are determined and extracted such that a reference delay shaft is determined, said reference delay shaft being a drive shaft having a delay that is less than a delay of another drive shaft, each of said drive shafts receiving said additional torque such that a delay of each of said drive shafts corresponds to said delay of said reference delay shaft.

3. The press device according to claim 1, wherein the data of torque as a function of time are determined and extracted such that a reference delay pressurizing point is determined, said reference delay pressurizing point having a delay that is less than a delay of another pressurizing point, each motor receiving said additional torque strengthening driving such that a delay of each of said motors corresponds to said delay of said delay pressurizing point.

4. The press device according to claim 1, wherein each of the plurality of motors for driving each of said drive shafts is constituted so as to rotate said drive shaft with at least two motors as a pair, said control means performs driving control for at least one of the motors based on a command value for rotating the pair of drive shaft, and performs driving control for additional driving for at least the other of said motors based on said data of torque against time or press position.

5. The press device according to claim 4, wherein the motor on the side of driving control based on said command value is constituted by a pulse motor, while the motor on the side of said additional driving is constituted by a servo motor.

6. A press device comprising:

a base;

a plurality of guide poles engaging said base such that each of said guide poles extend in an upright position;

a support plate supported in parallel with said base via said plurality of guide poles;

a slider mounted on said guide poles such that said slider is movable between said base and said support plate;

a plurality of pressurizing points distributed on said slider;

a plurality of drive shafts, each drive shaft engaging one of said pressurizing points;

a plurality of motors, each motor driving one of said drive shafts;

a control device for controlling each motor independently; and a plurality of displacement measuring means for measuring position displacement of said slider with respect to said base during actuation of said slider, said control device receiving displacement data from at least one of said displacement measuring means and torque data from each of said motors, said displacement data corresponding to inclination of said slide during movement of said slider based on rotation of one of said drive shafts, said torque data corresponding to torque supplied by each of said plurality of motors during movement of said slider, said control device providing an additional torque strengthening signal to each of said plurality of motors based on said displacement data and said torque data such that torque supplied by said plurality of motors is controlled independently to maintain said slider in a horizontal position.

7. The press device according to claim 6, wherein said torque data are determined and extracted such that a reference delay shaft is determined, said reference delay shaft being a drive shaft having a delay that is less than a delay of another drive shaft, each of said drive shafts receiving said additional torque strengthening signal such that a delay of each of said drive shafts corresponds to said delay of said reference delay shaft.

8. The press device according to claim 6, wherein said torque data are determined and extracted such that a reference delay pressurizing point is determined, said reference delay pressurizing point having a delay that is less than a delay of another pressurizing point, each motor receiving said additional torque strengthening signal such that a delay of each of said motors corresponds to said delay of said delay pressurizing point.

9. The press device according to claim 6, wherein each of the plurality of motors for driving each of said drive shafts is constituted so as to rotate said drive shaft with at least two motors as a pair, said control device controlling at least one of the motors based on a command value for rotating the pair of drive shaft, said control device controlling the other of said motors based on said torque data.

10. The press device according to claim 9, wherein the motor controlled based on said command value is a pulse motor and the motor controlled based on said torque data is a servo motor.

11. A press device comprising:

a base;

a plurality of guide poles engaging said base such that each of said guide poles extends in an upright position;

a support plate supported in parallel with said base via said plurality of guide poles;

a slider mounted on said guide poles such that said slider is movable between said base and said support plate;

a plurality of pressurizing points distributed on said slider;

a plurality of drive shafts, each drive shaft engaging one of said pressurizing points;

a plurality of motors, each motor driving one of said drive shafts;

a control device controlling each motor independently; and a plurality of displacement measuring means for measuring position displacement of said slider with respect to said base during actuation of said slider, said control device receiving displacement data from at least one of said displacement measuring means and torque data from each of said plurality of motors, said displacement data corresponding to inclination of said slide during movement of said slider based on rotation of one of said drive shafts, said torque data corresponding to torque supplied by each of said plurality of motors during movement of said slider, said control device controlling torque of each of said plurality of motors independently based on said displacement data and said torque data and a current position of said slider as detected via at least one of said displacement measuring means such that said slider is maintained in a horizontal position.

12. The press device according to claim 11, wherein said torque data are determined and extracted such that a reference delay shaft is determined, said reference delay shaft being a drive shaft having a delay that is less than a delay of another drive shaft, each of said drive shafts receiving said additional torque strengthening signal such that a delay of each of said drive shafts corresponds to said delay of said reference delay shaft.

13. The press device according to claim 11, wherein said torque data are determined and extracted such that a reference delay pressurizing point is determined, said reference delay pressurizing point having a delay that is less than a delay of another pressurizing point, each motor receiving said additional torque strengthening signal such that a delay of each of said motors corresponds to said delay of said delay pressurizing point.

14. The press device according to claim 11, wherein each of the plurality of motors for driving each of said drive shafts is constituted so as to rotate said drive shaft with at least two motors as a pair, said control device controlling at least one of the motors based on a command value for rotating the pair of drive shaft, said control device controlling the other of said motors based on said torque data.

15. The press device according to claim 14, wherein the motor controlled based on said command value is a pulse motor and the motor controlled based on said torque data is a servo motor.

* * * * *